US006250599B1

(12) United States Patent
Goldberg

(10) Patent No.: US 6,250,599 B1
(45) Date of Patent: Jun. 26, 2001

(54) UNIVERSAL BOOK HOLDER

(76) Inventor: Herbert E. Goldberg, 100 Newbury Ct. #612, Concord, MA (US) 01742

( * ) Notice: Subject to any disclaimer, the term of this patent is extended or adjusted under 35 U.S.C. 154(b) by 0 days.

(21) Appl. No.: 09/123,080

(22) Filed: Jul. 27, 1998

Related U.S. Application Data

(63) Continuation-in-part of application No. 08/791,113, filed on Jan. 30, 1997, now abandoned.
(60) Provisional application No. 60/011,041, filed on Feb. 2, 1996.

(51) Int. Cl.[7] ..... A47B 5/04
(52) U.S. Cl. ..... 248/444.1; 248/444.1; 248/445; 248/447.2
(58) Field of Search ..... 248/444.1, 447.2, 248/443, 446, 450, 451, 452, 453, 448, 454, 445, 441.1, 447, 447.1, 458, 281.42, 282

(56) References Cited

U.S. PATENT DOCUMENTS

| | | | | |
|---|---|---|---|---|
| 485,471 | * | 11/1892 | Morrison | 248/447.2 X |
| 2,337,675 | * | 12/1943 | McNeil | 248/445 |
| 3,350,150 | * | 10/1967 | Schwarm | 248/451 X |
| 4,239,171 | * | 12/1980 | Huls et al. | 248/444.1 X |
| 4,496,126 | * | 1/1985 | Melton et al. | 248/447.2 |
| 4,553,728 | * | 11/1985 | Corsello | 248/452 |
| 5,161,766 | * | 11/1992 | Arima | 248/444.1 X |
| 5,259,581 | * | 11/1993 | Goldberg | 248/445 X |
| 5,458,312 | * | 10/1995 | Goldberg | 248/444.1 |
| 5,489,079 | * | 2/1996 | Goldberg | 248/444.1 |
| 5,615,856 | | 4/1997 | Simington | 248/452 |

FOREIGN PATENT DOCUMENTS

| | | | | |
|---|---|---|---|---|
| 77700 | * | 2/1949 | (CH) | 248/451 |
| 14937 | * | 7/1896 | (GB) | 248/446 |

* cited by examiner

*Primary Examiner*—Ramon O. Ramirez
*Assistant Examiner*—Tan Le

(57) ABSTRACT

The Universal Book Holder permits a person to read from supine, sideways facing, sideways-upward facing as well as from the usual forward and downward facing postures. The book holder accepts hard cover books, paperbacks, magazines and newspapers. Insertion and removal of books is done by the user without changing his/her reading position and does not require any manual dexterity whatever.

11 Claims, 7 Drawing Sheets

UNIVERSAL BOOK HOLDER

This is a Continuation-In-Part of patent application Ser. No. 08/791,113 filed on Jan. 30, 1997, now abandoned, which claims priority of the Provisional Patent Application Ser. No. 60/011,041, filed on Feb. 2, 1996, and also claims the benefit of Document Disclosure No. 384,830, filed on Nov. 13, 1995.

SUMMARY OF THE INVENTION

This invention is directed to an improved book holder which allows a person to read from any position, such as sitting up, reclining, supine, or lying down and facing sideways. This is achieved by providing a structure which holds the reading matter securely in all positions while allowing easy removal and insertion, and a suitable stand for supporting it.

BACKGROUND OF THE INVENTION

This invention is concerned with a book holder which allows persons to read equally well from standing, sitting, reclining and supine positions, as well as lying down in left or right sideways facing positions. Two concepts which are useful in this description are the EYE LINE and the LINE OF SIGHT of a person.

The eye line is an imaginary line passing through both eyes of a person. The line of sight is an imaginary line which extends forward from a person's eye line along the direction of his or her versions.

For instance, the line of sight of someone driving a car would extend forward in a generally horizontal direction from the driver's eye line which is also horizontal. However, if that driver were to look at the speedometer, his or her eye line would remain horizontal, but the line of sight would then slope downward toward the speedometer. If the driver were to stop at an intersection, lean back and look to the left, for instance to check for oncoming traffic, his or her eye line would slant downward rather than stay horizontal, with the line of sight tilting accordingly.

THE PRIOR ART

When a person wishes to read a book held in a book holder, the lines of the text should be aligned with his or her eye line, and the plane of the text should extend generally perpendicularly to his/her line of sight. The commercially available models such as table easels, cookbook holders, cantilevered bedside tables and recliner readers were designed for users whose eye lines are horizontal, and who can move the book holder or in some cases tilt it about a horizontal axis to position it relative to their line of sight. Such book holders cannot be used by persons who read lying on their side facing sideways with their eye line slanting downward, or by many others who prefer to read while reclining in the armrest corner of a sofa, where their eye line and their line of sight slant obliquely. For these reasons Applicant believes that there is a need for a truly universal book holder which can be used in all of the situations described above, especially by those who like to change their reading posture from time to time, for instance from sitting in a recliner to lying down on a sofa, or by several members of a household who have different reading habits.

The patent literature on book holders goes back more than a century, and the field has been active, even crowded, ever since. However, the only reference to Universal Book holders in the art cited against the parent applications was one foreign patent. A US patent did issue in April 1997, but both of these patents approach the problem of reading in oblique positions in too complex a way to be useful, in Applicant's opinion. Applicant has reviewed US patent classes 248/444.1, 445, 452, and 454 for patents issued since the date of the parent application, but found no other applicable art. It is true, of course, that some structural members employed by Applicant have been used before, but the Applicant believes that no useful combination of these components been suggested in any of the references.

THE INVENTION

Recently most of the work has been concerned with the problem of page turning which inverted book holders pose. However, since all of these designs can only be used in certain reading situations as explained in the paragraph above, Applicant has analyzed the reading habits of persons who read lying down in supine and sideways facing positions and has concluded that, at least for recreational reading by persons who are not seriously handicapped, the problem lies in the fatigue of holding and flattening the book for the minutes it takes to read two facing pages, rather than in the few seconds of effort required for page turning, especially if the book holder design allows a page to be easily separated from the adjacent pages before it is turned.

Accordingly, the present invention addresses the design of book holders that can be used in all situations of reading by:

1. Providing a book holder that facilitates the insertion and removal of books of all types—hard covers as well as new or work paperbacks, magazines and newspapers.
2. Providing means to place a book holder in a great many reading positions so as to align it properly with the user's eye line and line of sight in all situations.
3. Providing means to move a book holder easily from one of the aforementioned reading positions to another.
4. Providing means to flatten any type of book, magazine, or newspaper in the book holder and to prevent it from moving within or falling out spontaneously, without depending on the type, quality, or presence of book covers.
5. Providing means to permit the reading of any lines of text that could be optically obscured by certain members of the book holder.
6. Providing a method of separating a page from adjacent pages before page turning.

SPECIFICATION

DESCRIPTION OF THE INVENTION

In the following description as well as in the claims the term "book" or "books" will also represent magazines, newspapers, pictures, and other matter being examined visually. Similarly the terms "front member" and "transparent front member" will be used to represent any structure which is transparent and rigid enough to allow sufficient visual access to, and support of, a book to serve the purpose, including filamentary arrays and grids.

Figure 1A:
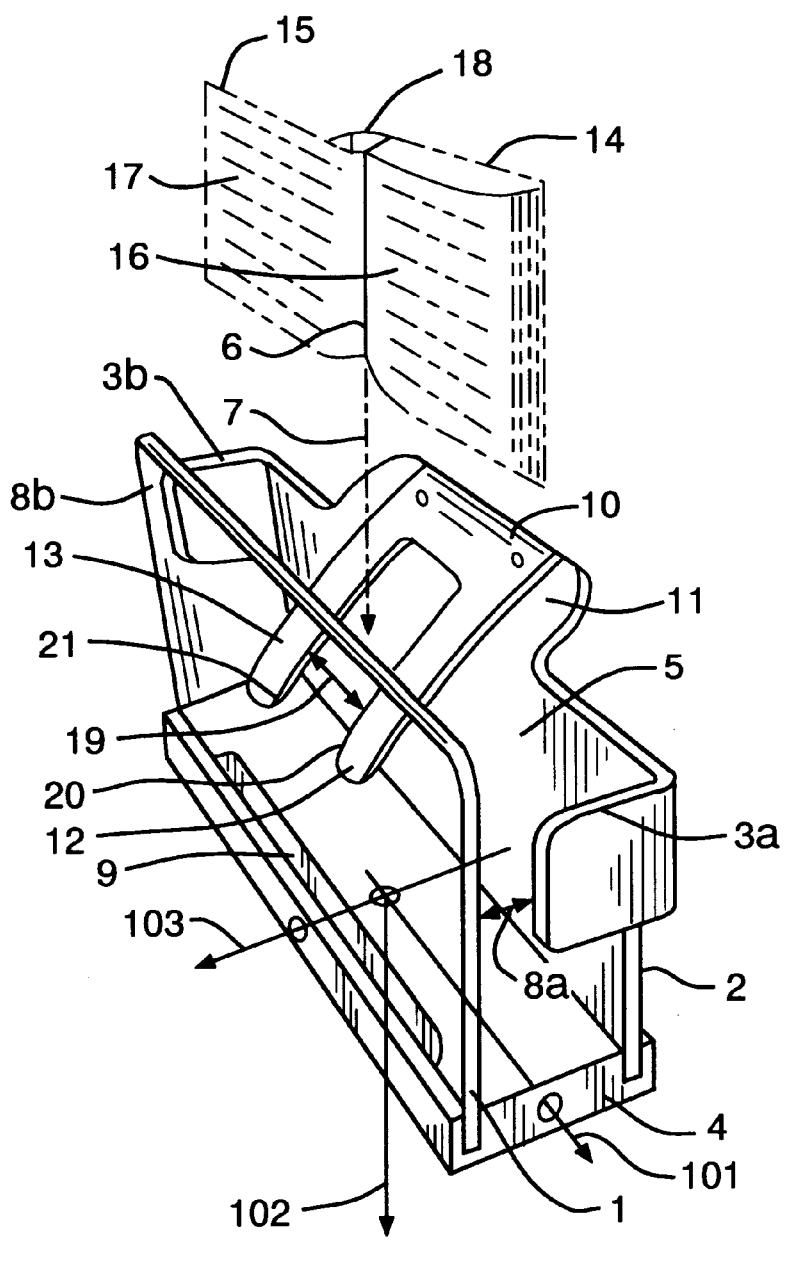
FIG. 1A is a perspective view of a Universal Book Holder.
Figure 1B:
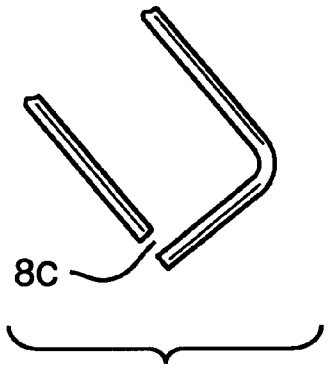
FIG. 1B shows an alternative detail of the book holder.

Referring now to FIG. 1A, a transparent front plate 1 and a back plate 2 with side wings 3*a* and 3*b* are attached to the base member 4 so as to form a book receiver 5 of generally rectangular cross section. An open book 6 is inserted from above into the enclosure 5 as indicated by arrow 7, to be supported by the base member 4. The figure shows spaces 8*a* and 8*b* between the wings 3*a* and 3*b* respectively and the front plate to allow open magazines, which usually are wider than most books, to protrude on either side. Another configuration of the spaces 1*c* is shown in FIG. 1B. However, this spacing is not a necessary feature because wide magazines can also be folded at the center crease, allowing one page to be viewed at a time. A vertical slot 9 is cut through the base member 4. It extends parallel to the front plate 1 for a length of about eight to ten inches at a width of ¼ to ½ inch so as to allow a vertically folded newspaper to be inserted into the device and moved up and down as required for reading.

Horizontally folded newspapers are also accepted by the book receiver, protruding through spaces 8*a,b,* and *c* in the same way as open magazines.

The upper portion 11 of the back plate 2 extends backward and upward, thus forming an angle with the front plate. This produces a funnel-like, tapered entrance to the enclosure 5, which assures easy insertion and removal of the book 6 from the enclosure. Typical values of the angle are in the 30 to 60 degree range.

The height of front plate 1 may be limited to about six inches above base member 4 to permit easy insertion and removal of seven inch high paperbacks. It also was found advantageous to make the front and back plates of the enclosure 5 of different heights, for instance by extending the height of the bent-over portion 11 of the back plate to seven or eight inches above the base 4. This creates a guide for inserting the book.

While a limit on the height of the front plate is important, it creates an optical discontinuity when hard covers or the increasingly popular large paperbacks are read. In practice this is objectionable only for appearance, but it can be overcome simply by applying a shallow bevel to the front plate edge. In the case of short productions runs where custom molding is not feasible, the problem may be solved by creasing a second stable position for the book a fraction of an inch above the base member, for instance by providing a temporary platform to support the book initially as described below.

Figure 2:
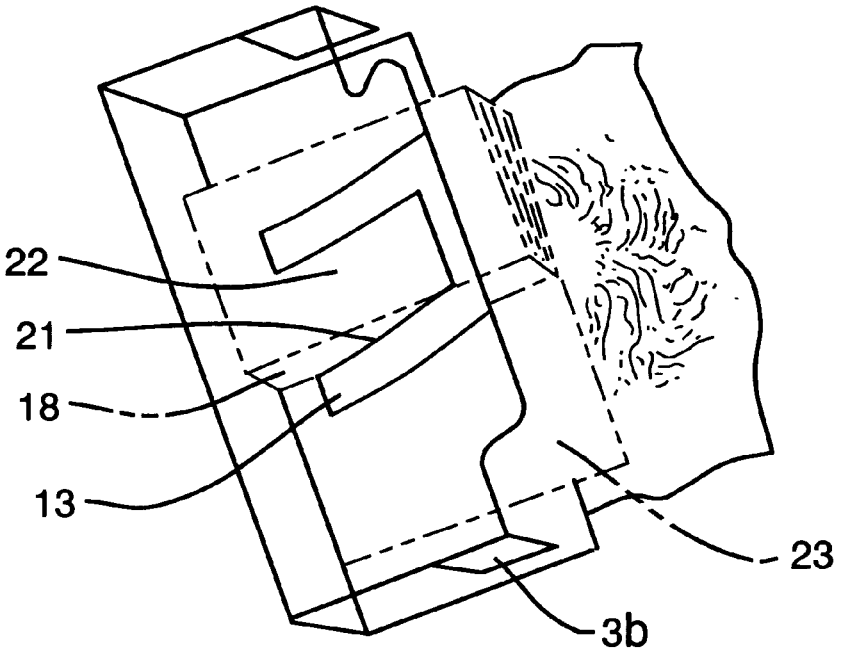
FIG. 2 shows the device in the orientation used by a person facing partially sideways.
Figure 3:
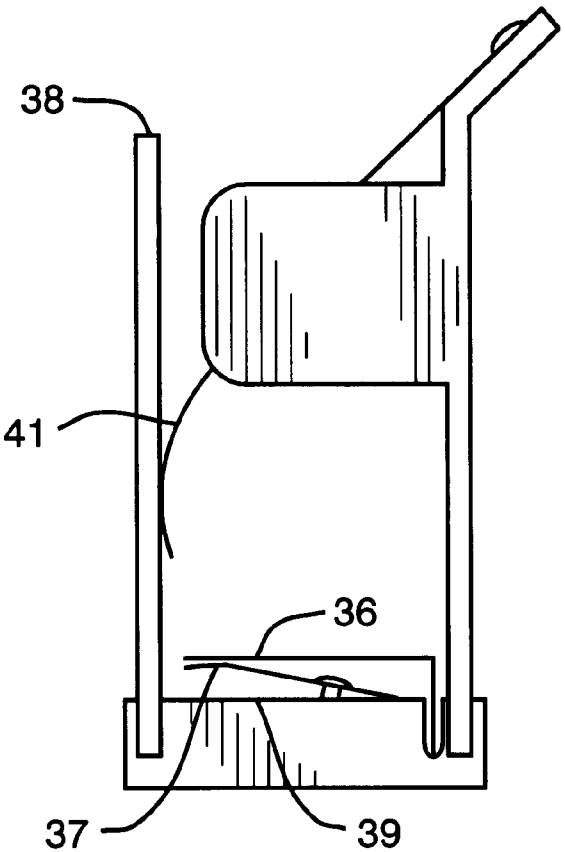

Two flat spring members 12 and 13 are attached to the bent-over portion 11 of the back plate 2. They have end areas 13 (FIG. 2), 41 (FIG. 3) and 98 (FIG. 7C), and are dimensioned and pre-bent to bear against the front plate 1 with sufficient pressure to create a pre-loaded condition. When an open book 6 is inserted into the enclosure 5, spring members 12 and 13 will bear against the front and back covers 14 and 15 of the book 6 respectively so as to flatten independently the two sides 16 and 17 of the book which are separated by its spine 18 (FIGS. 1A, 2). The aforementioned pre-loaded condition serves to minimize the change of spring pressure which occurs as the thickness of the two sides of the book changes when pages are turned. The spacing 19 between the edges 20 and 21 of the springs should be sufficiently wide to accommodate the spine of the thickest book which the book holder is expected to accept.

The inner edges 20 and 21 of spring members 12 and 13 are very important in the type of use illustrated in FIG. 2, where the book holder has been rotated about the transverse axis 103 (FIG. 1A) for alignment with the eye line of a person who is lying down in a sideways facing position. The spine 18 of the book is supported by the inner edge 21 of spring 13 to prevent the book from sliding sideways under the weight of its upper portion 22. Otherwise a weakened cover 23 and any adjacent pages of an old or worn paperback might be bent or crushed as they contact the wing 3*b*. The spring members 12, 13 must have sufficient lateral stiffness to support the book in such a situation.

Figure 7D:
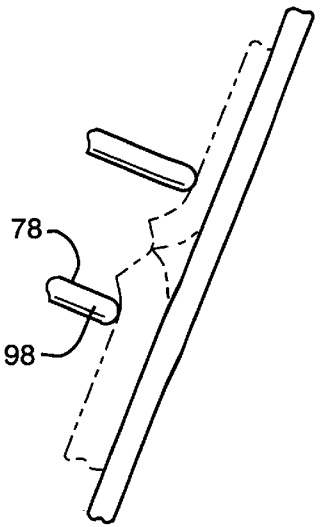
FIGS. 7A, 7B, 7C, 7D show the operation of a restraining member.
Figure 7C:
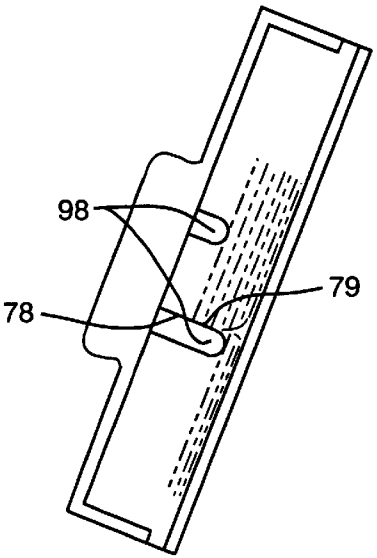
Figure 8:
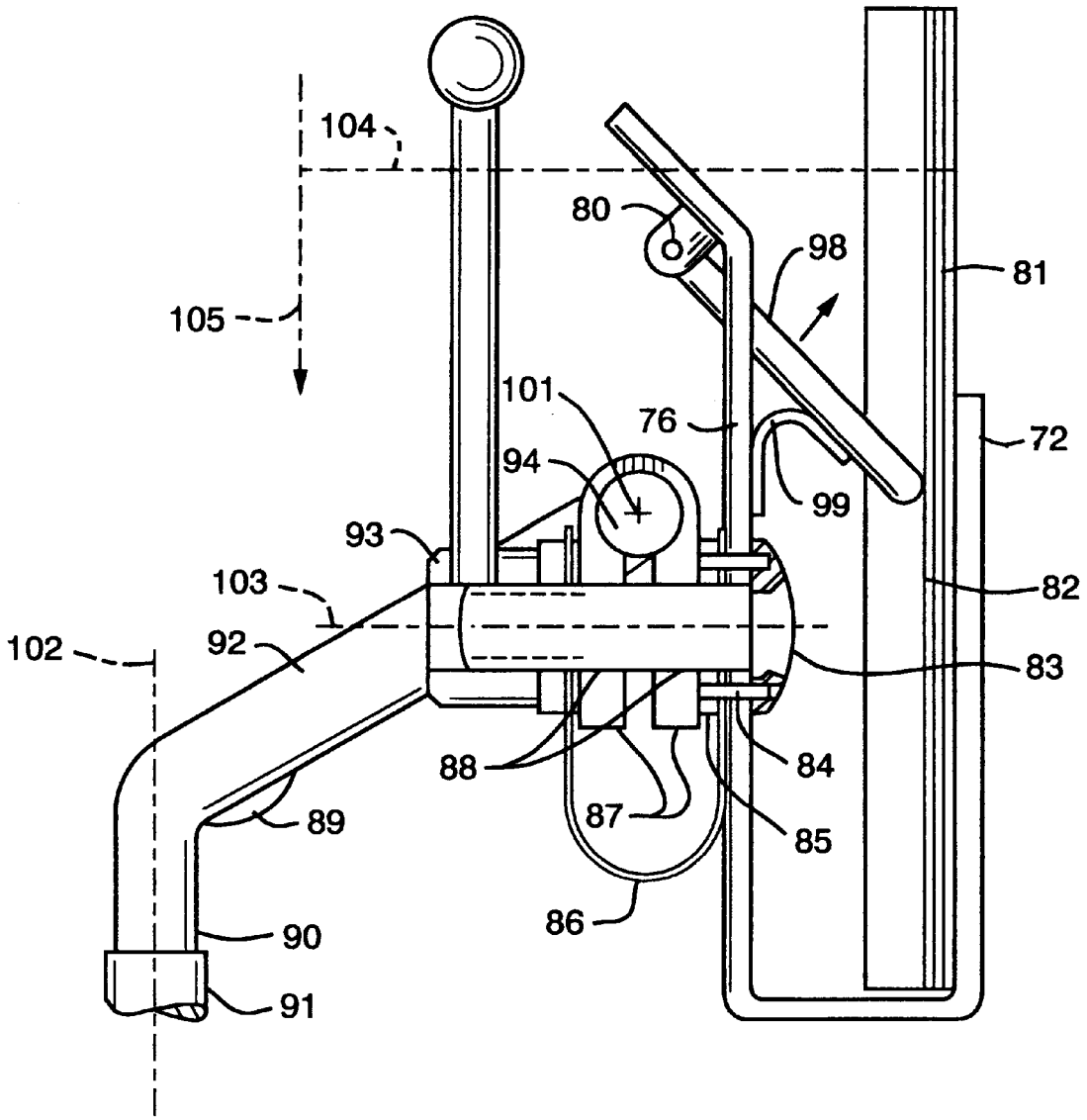
FIG. 8 shows another support system employing a single control.

FIGS. 7C, 7D, and 8 show details of an alternate design where springs 12, 13 have been replaced by rigid bars 98, hinged at point 80 to the bent-over part of the back member 76 and biased against the cover 82 of the book 81 by springs 99.

Figure 7B:
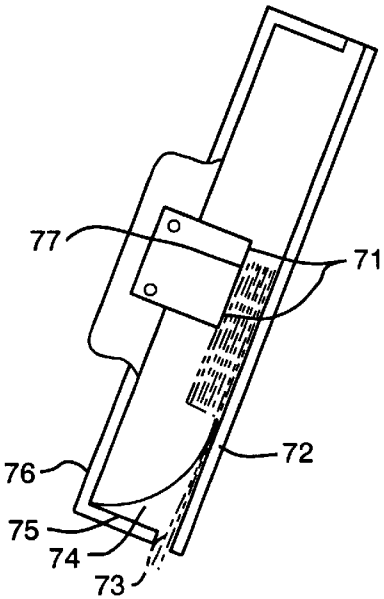
Figure 7A:
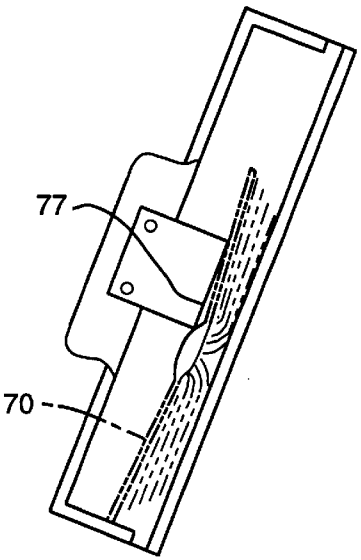

FIG. 7A shows that there is no problem for a hard cover book 70 because any hard cover is stiff enough to support the book, even if the friction force generated by the page flattening biasing spring, which is different from the book flattening force, is minimal. However, although the prior art in the patent literature continues to show hard cover books exclusively, todays's book market is dominated by "paperbacks" and "soft covers", sometimes having six or seven hundred pages of tough, thin paper in soft, slippery covers that are difficult to hold open.

FIG. 7B illustrates what can happen when such a soft cover or paperback book, opened near the beginning or the end of the text, is placed in a Conventional Book Holder. With the friction forces at the areas 71 being low, the book has moved downward under its own weight, with some pages passing through the opening 73, causing the soft cover 74 with a few adjacent pages to be caught and bent by the restraining wing member 75, and stopped by the back member 76.

The solution to the problem of damaging soft cover books in this way, already described above, is shown in more detail in FIGS. 7C and 8, where the stop members 98 extend movably across the book receiver between the front and back members 72 and 76 to touch the covers of the book. The figure shows how edge 78 of the stop member 98 engages the spine 79 of the book and prevents further lateral motion. If the book has been open at a page near the center of the book, as illustrated in FIG. 7D, the strongly concave area near the spine of the book would have been engaged by the edge 78 of the restraining member 98.

It is important to note that the springs 12, 13 as well as the bars 98 serve two functions. (1) they can flatten the pages of the book against the front member, and (2) they can restrain the book from sliding sideways along the base of the book receiver when it is tilted. The bars are rigid and will always limit sideways motion, and their biasing springs 99 can be made as strong as necessary for page flattening. Similarly, the flat springs 12 and 13 (FIG. 1A) may also be designed to respond to both requirements: their width controls the lateral stiffness, and their thickness determines the flattening pressure.

Figure 4:
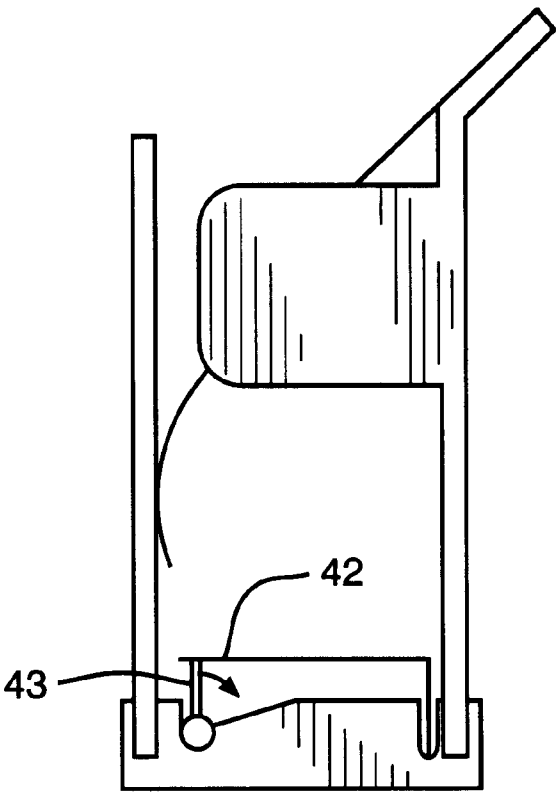
FIGS. 3 and 4 are side views of alternate mechanical ways of eliminating the edge shadow problem.

Turning now to a mechanical solution of the optical discontinuity problem discussed above, FIG. 3 shows a pivoting platform 36 which is urged upwards by springs 37 initially to support the book a fraction of an inch above the base 39. When the user gets close to the edge 38 of the front plate he or she can push the book downward and continue to read. The interaction of the springs 37 and the friction force generated by the book flattening springs 41 will keep the book in place while the obscured lines are read. FIG. 4 shows a variation of the preceding system, where the position of the moving platform 42 is manually controlled by a rotatably mounted lever 43.

SUPPORT STRUCTURES

As explained above, a universal book holder must be supported by a structure designed to meet two requirements:

1. The plane of the text to be read should extend at least in a general way perpendicularly to the user's line of sight, and
2. The text to be read must be aligned with the eye line of the user.

The existing commercial book holders meet the foregoing conditions easily, since all of them were designed for users in standing, sitting, and normal reclining or supine reading postures only, where their eye line is always horizontal. By contrast, the structures supporting a Universal Book Holder must allow alignment with eye line orientations ranging from horizontal for users in upright or in normal reclining postures, to slanting at any angle for those who lie facing sideways or who recline into the corner of a sofa. Universal Book Holders must thus be allowed to rotate about three roughly orthogonal axes.

The task of positioning the book receiver correctly is greatly simplified if the respective axes of rotation 101, 102, and 103, are placed to extend respectively parallel and perpendicularly to the base member as shown in FIG. 1A, and if the three rotations act "independently", meaning that any one of them will not substantially interfere with adjustments controlled by the other rotations.

The three alternate control systems described below have been designed to be operated by the user from his/her reading position.

Figure 5:
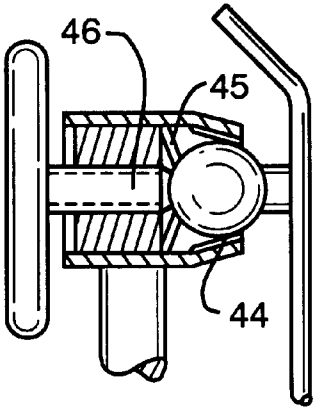
FIG. 5 shows a support system employing a ball joint.

The bail joint of FIG. 5 is one of the simplest of these devices, but since it can move in all directions when its lock is released, it could confuse some users looking only for small adjustments. Mounting it on the back member of the book receiver, as shown in FIG. 5, limits rotation about the horizontal axis to about 90 degrees, which, however, may not be adequate for all applications. As shown in the figure, it includes a friction member 44 and a Belville spring 45 to present spontaneous motion if the lock 46 is opened too far.

Figure 6:
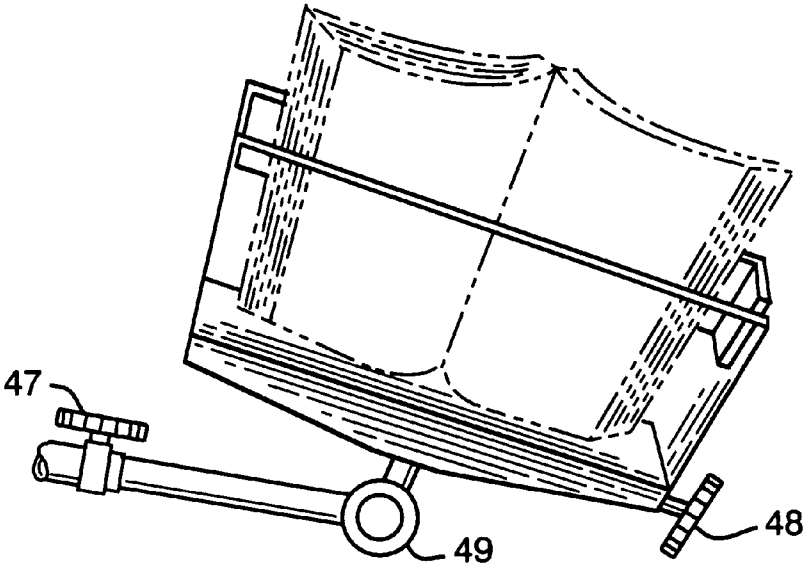
FIG. 6 shows a location of the controls of a support system.

Another system of controlling rotation is pictured in FIG. 6, where three knobs 47, 48, and 49, which lock rotation, are clearly separated, and where knob 48 controls a full 360 degree rotation about the vertical, which is useful to convert the book holder from right to left side use. Spring washers should be inserted below all control knobs to prevent rapid spontaneous rotations of the book holder when the control knob is loosened.

FIG. 8 shows a third rotation control system. It uses a single clamping member 93 to control rotation about the horizontal and transverse axes, and allows about 150 degrees of rotation about the horizontal axis 101 as compared with about 90 degrees permitted by the ball joint of FIG. 5. Rotation about the vertical axis is separate in either system, but this is not a disadvantage in this instance, becuase this rotation does not affect the height of the center of gravity of the book receiver and thus does not require adjustable clamping.

The axle bolt 83, back member 76, rotation transmitting member 86, and friction pad 85 are forced by connecting rivets 84 to rotate together in bearings 88 (transverse axis 103) of the intermediate member 87, which in turn can rotate about the horizontal upper portion 94 of angle rod 92 (horizontal axis). The clamping member 93 controls the clamping torques for rotation about the 101 and 103 axes. Rotation about the vertical axis 102 takes place at the junction 90 of angle rod 92 with a floor stand or with an under-the-mattress platform post 91.

The elevation of the book receiver with respect to the user's eye line, as well the distance between eye line and book receiver may change with axis 101 rotation. However, the changes are negligible if the horizontal axis of rotation 101 is placed within an area extending to six inches behind the front member as delineated by boundary line 104, 105, FIG. 8.

A mechanical stop 89 should be provided to limit downward rotation of the book receiver abut the horizontal axis to about 60 degrees from the vertical.

BOOK INSERTION AND PAGE TURNING

The problems of book insertion and removal and of page turning have always been serious obstacles to designers of INVERTED book holders. Many patents have issued on the subject, almost all of them proposing to secure the book in the book holder by clamps, clips, or VELCRO® strips, to be moved and tightened by the user. Pages were to be turned by moving them into and out of restraining members one at the time, making browsing impossible. The problems are even more complex for UNIVERSAL book holders which must also operate from upward facing and sideways tilting positions.

The recent U.S. Pat. No. 5,615,856 to Simington is an example of what has been proposed heretofore, and why there is a paucity of disclosures of truly universal book holders in this otherwise crowded field.

These complication may be overcome by simplifying the removal and re-insertion of a book as well as the turning of pages to the point where it will be acceptable for recreational reading, this method being based on the difference between active and passive inserting, retaining and restraining of books in a book holder.

ACTIVE INSERTING is a procedure whereby insertion of a book into a book holder requires movement of mechanical components of the book holder by the user, examples being shown in U.S. Pat. No. 5,615,856, (1997), lines 6 to 45, and in Czech Patent 77,700 (1959), FIG. 3, where four springs and clips 16,17,18,19 retain the pages of a hard cover book.

PASSIVE INSERTING is a procedure whereby the user can, without leaving his/her reading position, simply insert a book into the book holder, where it is retained automatically.

ACTIVE and PASSIVE REMOVAL of a book from a book holder are defined in the same ways.

Similarly, the terms ACTIVE and PASSIVE RESTRAINING apply, depending on whether action by the user is required to position restraining members in order to limit spontaneous movement of the book in the book receiver after insertion of a book, or whether the restraining members act automatically after insertion.

Figure 9:
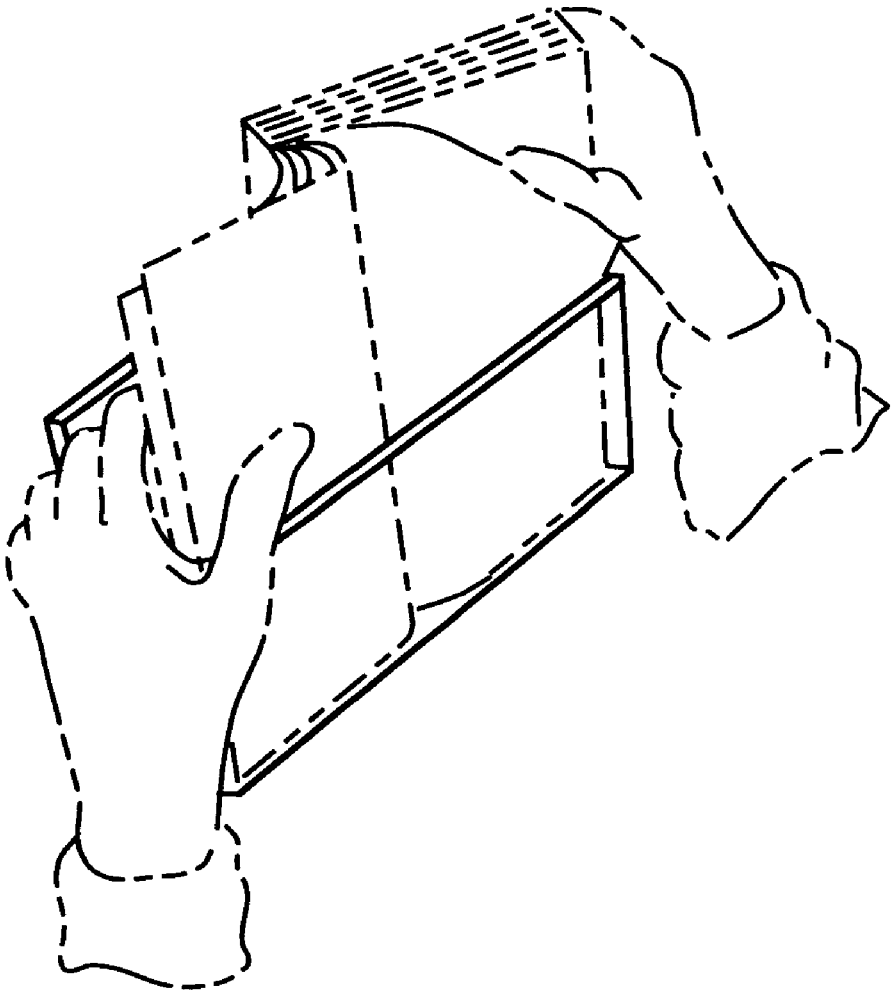
FIG. 9 shows ways of separating a page from adjacent pages before page turning.

The book holder described in this specification operates exclusively in the passive modes defined above and may be oriented and aligned by users from any desired reading position without substantially altering the elevation or reading distance of the book receiver relative to the user. Pages may be turned as illustrated in FIG. 9 as follows:

1. Separate the corner of the page to be tuned by lifting it from the adjacent pages, using the forefinger or the thumb of the proximate hand while the book remains in the book holder, as shown in FIG. 9.

2. Lift the book, then turn the lifted page and re-insert the book using both hands as shown in FIG. 9, into the book receiver.

Having described my invention, I claim:

1. In a book holder comprising a support structure permitting a person with an eye line to read a book having front and back covers and lines of text with an alignment with respect to said eye line, said person lying down supine, facing upward, sideways, or sideways/upward, and a book receiver comprising a transparent front member (1), a base member, and a back member for holding said book, and said front and back covers being connected by a spine (18) having a width and two sides, said support structure including means permitting said person to adjust said alignment by rotating said book receiver about a first axis of rotation (103) extending perpendicularly to said front member, the improvement including a set of two passively acting stop members (12,13) and (98), spaced to bridge said width of said spine and said two stop members having ends, said ends extending movably across said book receiver towards said front members (1), being biased to contact said front and back covers respectively, but being substantially immovable in a lateral direction parallel to said front member, said stop members having inner edges (21) and (78) capable of engaging said spine (18) and (79) for mechanically limiting sideways motion of said book in said book receiver when said book receiver is tilted by said person about said first axis of rotation to adjust said alignment.

2. In a book holder according to claim 1, a further improvement including first rotation means comprising a first axle (83) being attached to said book receiver extending substantially perpendicularly to said front member (1), and an intermediate member (87/88) adapted to be rotated about said first axle and to be secured to said book receiver by a clamping member (93) pressing said intermediate member against said book receiver, and further including second rotation means comprising a second axle (94) being attached to said support structure (92), extending substantially in parallel with said front member and said intermediate member (87/88) adapted to be rotated about said second axle and to be secured to said support structure by said clamping member (93) squeezing said intermediate member, whereby said first and second rotation means are clamped by a single clamping member (93).

3. A book holder according to claim 1, said transparent front member having an upper edge (38) positioned less than six inches above said base member.

4. A book holder according to claim 1, at least one of said two stop members being a rigid member (98), being pivoted and biased to rest against said front member or against a cover of said book.

5. A book holder according to claim 1, at least one of said two stop members being a member (12) which is complaint in a direction perpendicular to said front member (1) and is biased to rest against said front member or against a cover of said book.

6. A book holder according to claim 1, said book receiver further comprising at least one restraining member **(3*a*) being attached to a side of said back member and extending across said book receiver toward said front member to a point being spaced from said front member, for preventing books from sliding out of said book receiver when it is titled sideways, and for creating an opening (8*a*)** through which wide and thin reading matter such as newspapers and open magazines may pass.

7. A book holder according to claim 1, and further defining a vertical slot (9) passing through said base member, said opening extending parallel to said front member and being adapted to permit a vertically folded newspaper page to enter the book receiver by passing through said opening.

8. A book holder according to claim 1, said book holder further comprising an auxiliary, retractable book support member (36) and (42) within said book receiver, positioned above said base member, to support lower edges of said book at a distance above said base member for raising or lowering said book temporarily as the case may be, whenever said upper edge of said front member should obscure a line of said text.

9. A book holder according to claim 8, wherein said retractable book support member is a spring actuated member.

10. A book holder according to claim 8, wherein said retractable book support member is a lever actuated member.

11. A method of holding a book having front and back covers connected by a spine, and of turning pages for a person wishing to read while sitting, reclining, lying down, either supine or facing sideways, the person having a proximate hand, thumb, and forefinger in relation to the pages to be turned, the method comprising:

(a) Passively inserting the book into a book retaining space extending between a front member (1) and two stop members (12, 13), (98) of a book receiver, with the two stop members respectively contacting the front and back covers of the book, and with the spine positioned between the stop members, (b) Passively separating a page to be turned from adjacent pages by inserting the thumb or forefinger of the proximate hand under the page to be turned, (c) Raising the book above the front member and turning the separated page, (d) Passively reinserting the book by lowering it into the book retaining space.

* * * * *